United States Patent [19]

Noguchi

[11] 4,167,299

[45] Sep. 11, 1979

[54] ELECTRICAL RECEPTACLE WITH RELEASABLE TAB LATCHING MEANS

[75] Inventor: Masaro Noguchi, Sagamihara, Japan

[73] Assignee: AMP Incorporated, Harrisburg, Pa.

[21] Appl. No.: 922,263

[22] Filed: Jul. 6, 1978

[30] Foreign Application Priority Data

Jul. 7, 1977 [GB] United Kingdom ..... 28455/77

[51] Int. Cl.[2] ..... H01R 13/42; H01R 13/62

[52] U.S. Cl. ..... 339/59 R; 339/74 R; 339/258 S

[58] Field of Search ..... 339/59 R, 74 R, 75 R, 339/217 S, 258 S, 256 SP

[56] References Cited

U.S. PATENT DOCUMENTS 3,976,348 8/1976 Simmons ..... 339/74 R

*Primary Examiner*—Neil Abrams

*Attorney, Agent, or Firm*—Allan B. Osborne

[57] ABSTRACT

An electrical connector comprises a tab receptacle having means to latch to a tab mated therewith, the receptacle being contained in an insulating housing having a depressible portion operative to effect release of the latching arrangement acting between the tab receptacle and a tab mated therewith, the depressible portion also serving to retain the tab receptacle in the housing.

3 Claims, 2 Drawing Figures

ELECTRICAL RECEPTACLE WITH RELEASABLE TAB LATCHING MEANS

Figure 1:
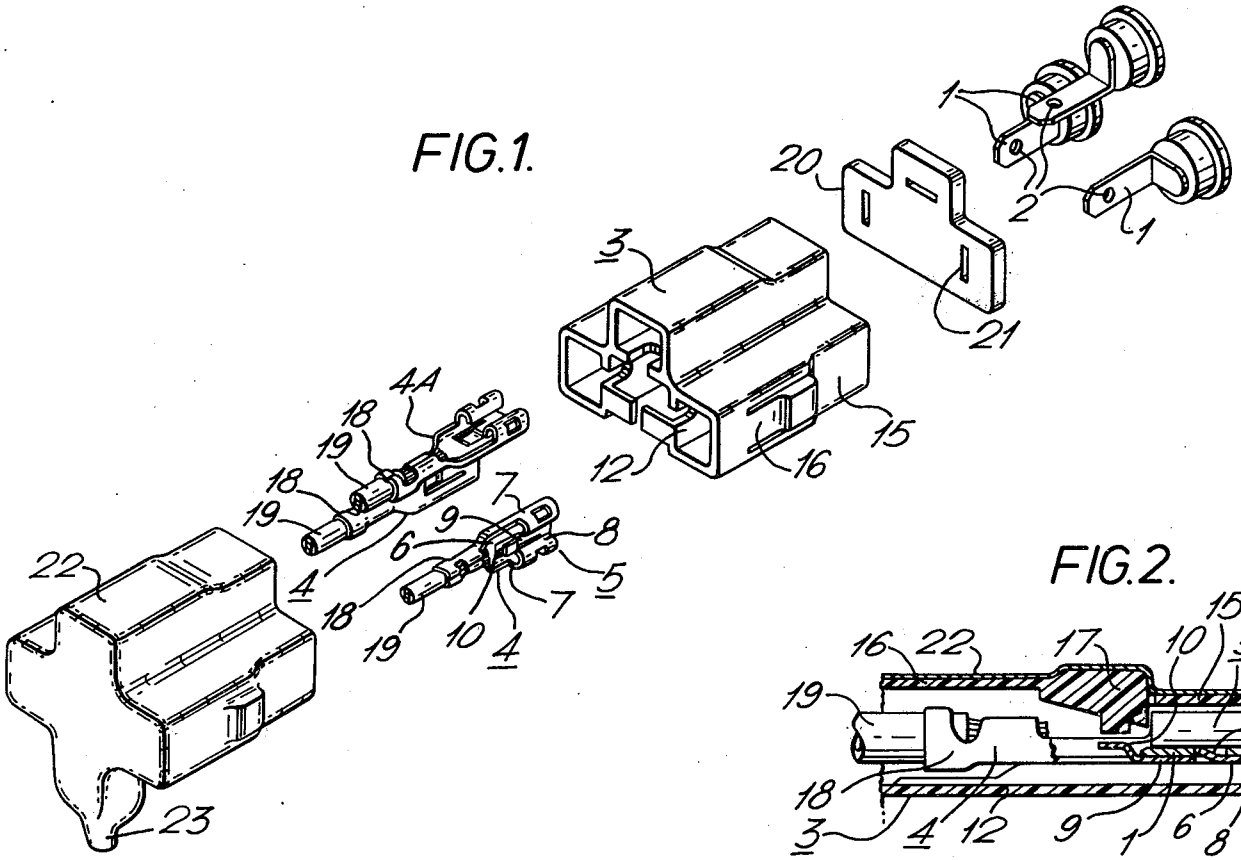

This invention relates to an electrical connector.

In U.S. Pat. No. 3,976,348 there is described an electrical tab receptacle formed from sheet metal and comprising a generally channel shaped receptacle portion having a base and upstanding side walls with free edge portions of the side walls turned in over the base for receiving a complementary electrical tab between the base and the turned in edge portions of the side walls. An integral tongue extends from the base at the forward, tab entry end of the receptacle portion, the tongue extending rearwardly within the receptacle portion, and the free end of the tongue at the rearward end of the receptacle portion projecting away from the base. The tongue is formed within the receptacle portion with a lance inclined rearwardly towards the turned in edge portions of the side walls, the lance being adapted and arranged to engage in a recess or aperture in a tab when mated with the receptacle for latching the tab against withdrawal from the receptacle.

Depression of the free end of the tongue towards the base effects release of the lance on the tongue from the recess or aperture in the tab when it is required to withdraw the tab from the receptacle, such depression being effected either manually or preferably by means of an appropriately constructed housing in which the receptacle is secured.

In the receptacle and housings specifically described in the above noted specification, the free end of the tongue extends externally of the receptacle portion for engagement by either a resiliently deflectable wall portion of a housing, or by a cam surface of a housing. The tongue is turned back from the forward edge of the base in order to give a substantial tongue length, and thus resiliency, and the receptacle is secured in the housing by engagement between the base of the receptacle and the adjacent wall of the housing.

Such a receptacle is relatively expensive to manufacture in view of the metal needed for the tongue and the manner of securing the receptacle in the housing, and the manner of effecting depression of the tongue to effect release of a mated tab requires the housing to have at least two (upper and lower) specifically shaped walls.

According to this invention an electrical connector comprises an electrical tab receptacle formed from sheet metal and comprising a generally channel shaped receptacle portion having a base and upstanding side walls with free edge portions of the side walls turned in over the base for receiving a complementary electrical tab between the base and the turned in edge portions of the side walls, there being an integral tongue struck from the base and extending from the base at the forward, tab entry end of the receptacle portion, the tongue extending rearwardly within the receptacle portion, a free end portion of the tongue at the rearward end of the receptacle portion being bent to project away from the base, and the tongue being formed within the receptacle portion with a lance inclined rearwardly towards the turned in edge portions of the side walls, the lance being adapted and arranged to engage in a recess or aperture in a tab when mated with the receptacle for latching the tab against withdrawal from the receptacle, the connector also comprising a housing of electrically insulating material in which the receptacle is secured, the housing having a bottom wall on which the base of the receptacle rests, a front wall which is engaged by the forward end of the receptacle to prevent withdrawal of the receptacle from the housing with the forward end of the receptacle leading, the front wall being formed with a hole to admit a tab for mating with the receptacle in the housing, and an upper wall formed with a resiliently depressible portion having an inwardly directed projection which engages behind the rear ends of the turned in edge portions of the side walls of the receptacle to prevent withdrawal of the receptacle from the housing with the forward end of the receptacle trailing, and which, when the depressible portion is depressed towards the base of the receptacle, engages the free end portion of the tongue of the receptacle and thereby depresses the tongue towards the base of the receptacle to effect release of the lance on the tongue from the recess or apertures of a tab mated with the receptacle to permit withdrawal of the tab from the receptacle.

Such a connector provides the same advantages as the connector described in the above noted specification, while being relatively cheap and easy to manufacture.

Figure 2:
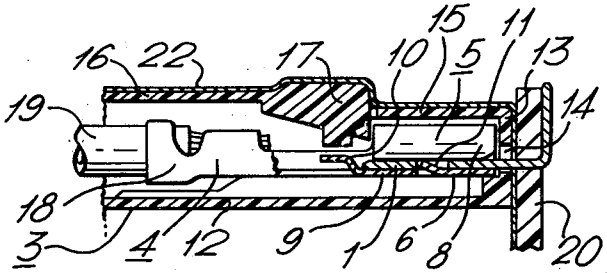

An electrical connector according to this invention will now be described by way of example with reference to the drawing in which:

FIG. 1 is an exploded view of the connector together with tabs for mating therewith, and FIG. 2 is a longitudinal vertical sectional view through part of the connector of FIG. 1.

The connector to be described is for establishing electrical connections to headlights in an automobile.

The automobile headlight unit has three projecting electrical tabs 1 each having an aperture 2 therein, and the connector comprises a housing 3 of electrically insulating plastics material, containing three tab receptacles 4 arranged for mating with the tabs 1.

The connector is thus in effect three separate connectors having integrally formed tubular housings.

Only two of the separate connectors (these being the two lower ones in FIG. 1) have the features of the present invention, and only one of these two connectors (the righthand one in FIG. 1) will be described in detail.

This one connector comprises an electrical tab receptacle 4 formed from sheet metal and comprising a generally channel shaped receptacle portion 5 having a base 6 and upstanding side walls 7 with free edge portions 8 of the side walls 7 turned in over the base 6 for receiving the associated tab 1 between the base 6 and turned in edge portions 8 of the side walls 7. An integral tongue 9 is struck from the base 6 and extends from the base 6 at the forward, tab entry end of the receptacle portion 5, rearwardly within the receptacle portion 5, a free end portion 10 of the tongue 9 at the rearward end of the receptacle portion being bent to project away from the base 6. The tongue 9 is formed within the receptacle portion 5 with a lance 11 inclined rearwardly towards the turned in edge portions 8 of the side walls 7, the lance 11 being adapted and arranged to engage in the aperture 2 in the associated tab 1 when mated with the receptacle 4 for latching the tab 1 against withdrawal from the receptacle 4.

The connector also comprises the housing 3 of electrically insulating material in which the receptacle is secured, the housing 3 having a bottom wall 12 on which the base 6 of the receptacle 4 rests, a front wall 13 which is engaged by the forward end of the receptacle 4 to prevent withdrawal of the receptacle 4 from the housing 3 with the forward end of the receptacle 4 leading, the front wall 13 being formed with a hole 14 to admit the tab 1 for mating with the receptacle 4 in the housing 3, and an upper wall 15 formed with a resiliently depressible arm portion 6 having its root adjacent the rear end of the receptacle 4, and having an inwardly directed projection 17 at its free end, which engages behind the rear ends of the turned in edge portions 8 of the side walls 7 of the receptacle 4 to prevent withdrawal of the receptacle 4 from the housing 3 with the forward end of the receptacle 4 trailing, as shown in FIG. 2.

The arrangement is such that when the depressible portion 16 is depressed towards the base 6 of the receptacle 4, the projection 17 engages the free end portion 10 of the tongue 9 of the receptacle 4 and thereby depresses the tongue 9 towards the base 6 of the receptacle 4 to effect release of the lance 11 on the tongue 9 from the aperture 2 in the tab 1 mated with the receptacle 4 to permit withdrawal of the tab 1 from the receptacle 4.

As mentioned above only two of the separate connectors shown have the features of the present invention, and the receptacle 4A of the upper (as seen in FIG. 1) connector is a conventional receptacle which does not provide the tab latching and release features provided by the other two connectors.

Each of the receptacles 4 and 4A has a wire connection portion 18 for crimping, in known manner, about the insulation and conductive core of an individual insulated conductor 19, and thus the connector can be used to provide connections between the conductors 19 and the tabs 1.

In use a resilient sealing member 20 having apertures 21 for the tabs 1 is positioned over the tab entry end of the housing 1, and the housing 3 containing the receptacles 4 and 4A is contained in a waterproof cover 22; whereby the complete connector is sealed against the ingress of moisture. The cover 22 is formed with a lead out 23 for the conductors 19.

What is claimed is:

1. An electrical connector comprising an electrical tab receptacle formed from sheet metal and comprising a generally channel shaped receptacle portion having a base and upstanding side walls with free edge portions of the side walls turned in over the base for receiving a complementary electrical tab between the base and the turned in edge portions of the side walls, there being an integral tongue struck from the base and extending from the base at the forward, tab entry end of the receptacle portion, the tongue extending rearwardly within the receptacle portion, a free end portion of the tongue at the rearward end of the receptacle portion being bent to project away from the base, and the tongue being formed within the receptacle portion with a lance inclined rearwardly towards the turned in edge portions of the side walls, the lance being adapted and arranged to engage in a recess or aperture in a tab when mated with the receptacle for latching the tab against withdrawal from the receptacle, the connector also comprising a housing of electrically insulating material in which the receptacle is secured, the housing having a bottom wall on which the base of the receptacle rests, a front wall which is engaged by the forward end of the receptacle to prevent withdrawal of the receptacle from the housing with the forward end of the receptacle leading, the front wall being formed with a hole to admit a tab for mating with the receptacle in the housing, and an upper wall formed with a resiliently depressible portion having an inwardly directed projection which engages behind the rear ends of the turned in edge portions of the side walls of the receptacle to prevent withdrawal of the receptacle from the housing with the forward end of the receptacle trailing and which, when the depressible portion is depressed towards the base of the receptacle, engages the free end portion of the tongue of the receptacle and thereby depresses the tongue towards the base of the receptacle to effect release of the lance on the tongue from the recess or apertures of a tab mated with the receptacle to permit withdrawal of the tab from the receptacle.

2. A connector as claimed in claim 1, in which the resiliently depressible portion of the upper wall of the housing is an arm portion having its root adjacent the rear end of the receptacle.

3. A connector as claimed in claim 1 or claim 2, in which the housing containing the receptacle is contained in a flexible waterproof cover.

* * * * *